US005355795A

United States Patent [19]

Moss et al.

[11] Patent Number: 5,355,795

[45] Date of Patent: Oct. 18, 1994

[54] AUTOMATIC PLATE-LOADING CYLINDER FOR USE WITH PLATE-IMAGING SYSTEMS

[75] Inventors: James R. Moss, Satellite Beach, Fla.; Frank G. Pensavecchia, Hudson; John P. Gardiner, Londonderry, both of N.H.

[73] Assignee: Presstek, Inc., Hudson, N.H.

[21] Appl. No.: 112,789

[22] Filed: Aug. 26, 1993

[51] Int. Cl.[5] ..... B41J 7/20

[52] U.S. Cl. ..... 101/141; 101/132; 101/136; 355/213

[58] Field of Search ..... 101/132, 141, 415.1, 101/463.1, 465, 466, 467, 212, 216; 242/67.3 R; 346/136; 355/200, 213, 211, 208

[56] References Cited

U.S. PATENT DOCUMENTS

| | | | |
|---|---|---|---|
| 866,624 | 9/1907 | Collier | 101/46 |
| 3,491,684 | 1/1970 | Borinsky | 101/132 |
| 3,600,086 | 8/1971 | Cates et al. | 101/132 X |
| 3,821,931 | 7/1974 | Yamaji et al. | 101/132 |
| 3,826,570 | 7/1974 | Kolibas | 101/132 X |
| 3,926,515 | 12/1975 | Nagahara | 355/213 |
| 4,076,183 | 2/1978 | Kingsley | 242/67.3 R |
| 4,076,410 | 2/1978 | Kono et al. | 242/67.3 R X |
| 4,097,138 | 6/1978 | Kingsley . | |
| 4,102,570 | 7/1978 | Shimoda | 355/16 |
| 4,231,652 | 11/1980 | Moser et al. . | |
| 4,239,375 | 12/1980 | Eisbein et al. | 355/16 |
| 4,400,083 | 8/1983 | Beisty et al. | 355/211 |
| 4,477,180 | 10/1984 | Bustamange | 355/208 |
| 4,575,890 | 3/1986 | Hidle | 15/104.002 |
| 4,769,652 | 9/1988 | Cleary et al. | 346/136 |
| 4,919,047 | 4/1990 | Inouye et al. | 101/175 |
| 4,936,211 | 6/1990 | Pensavecchia | 101/136 |
| 5,163,368 | 11/1992 | Pensavecchia et al. | 101/467 X |

FOREIGN PATENT DOCUMENTS

| | | | |
|---|---|---|---|
| 0683132 | 11/1952 | United Kingdom | 101/132 |

*Primary Examiner*—Edgar S. Burr
*Assistant Examiner*—Christopher A. Bennett
*Attorney, Agent, or Firm*—Cesari and McKenna

[57] ABSTRACT

A winding assembly especially suitable for use in conjunction with a system for automated imaging of lithographic plate material, including on-press imaging systems. A feeder spool installed within a plate-support cylinder contains a rolled supply of plate material, which wraps around the cylinder and is received by an uptake spool, also located within the cylinder. The assembly is driven by the same power source used to rotate the plate-support cylinder, and maintains a strong tension along the wrapped material.

8 Claims, 4 Drawing Sheets

AUTOMATIC PLATE-LOADING CYLINDER FOR USE WITH PLATE-IMAGING SYSTEMS

BACKGROUND OF THE INVENTION

A. Field of the Invention

The present invention relates generally to planographic printing, and in particular to an apparatus for continuously supplying new plate material to the plate cylinder of planographic printing press or plate-imaging apparatus.

B. Description of the Related Art

Traditional techniques of introducing a printed image onto a recording material include letterpress printing, gravure printing and offset lithography. All of these printing methods require a plate, usually loaded onto a plate cylinder of a rotary press for efficiency, to transfer ink in the pattern of the image. In letterpress printing, the image pattern is represented on the plate in the form of raised areas that accept ink and transfer it onto the recording medium by impression. Gravure printing plates, in contrast, contain series of wells or indentations that accept ink for deposit onto the recording medium; excess ink must be removed from the plate by a doctor blade or similar device prior to contact between the plate and the recording medium.

In the case of offset lithography, the image is present on a plate or mat as a pattern of ink-accepting (oleophilic) and ink-repellent (oleophobic) surface areas. In a dry printing system, the plate is simply inked and the image transferred onto a recording medium; the plate first makes contact with a compliant intermediate surface called a blanket cylinder which, in turn, applies the image to the paper or other copying medium. In typical rotary press systems, the recording medium is attached to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The fountain solution prevents ink from adhering to the non-image areas, but does not affect the oleophilic character of the image areas.

The plates for an offset press are usually produced photographically. In a typical negative-working subtractive process, the original document is photographed to produce a photographic negative. This negative is placed on an aluminum plate having a water-receptive oxide surface coated with a photopolymer. Upon exposure to light or other radiation through the negative, the areas of the coating that received radiation (corresponding to the dark or printed areas of the original) cure to a durable oleophilic state. The plate is then subjected to a developing process that removes the uncured areas of the coating (i.e., those which did not receive radiation, corresponding to the non-image or background areas of the original), and these non-cured areas become oleophobic and/or hydrophilic.

If a press is to print in more than one color, a separate printing plate corresponding to each color is required, each such plate usually being made photographically as just described. In addition to preparing the appropriate plates for the different colors, the operator must mount the plates properly on the plate cylinders of the press, and coordinate the positions of the cylinders so that the color components printed by the different cylinders will be in register on the printed copies. Each set of cylinders associated with a particular color on a press is usually referred to as a printing station.

In most conventional presses, the printing stations are arranged in a straight or "in-line" configuration. Each such station typically includes an impression cylinder, a blanket cylinder, a plate cylinder and the necessary ink (and, in wet systems, water) assemblies. The recording material is transferred among the print stations sequentially and in register, each station applying a different ink color to the material to produce a composite multicolor image. Another configuration, described in U.S. Pat. No. 4,936,211 (co-owned with the present application and hereby incorporated by reference), relies on a central impression cylinder that carries a sheet of recording material past each print station, eliminating the need for mechanical transfer of the medium to each print station.

With either type of press, the recording medium can be supplied to the print stations in the form of cut sheets or a continuous "web" of material. The number of print stations on a press depends on the type of document to be printed. For mass copying of text or simple monochrome line art, a single print station may suffice. To achieve full tonal rendition of more complex monochrome images, it is customary to employ a "duotone" approach, in which two stations apply different densities of the same color or shade. Full-color presses apply ink according to a selected color model, the most common being based on cyan, magenta, yellow and black (the "CMYK" model). Accordingly, the CMYK model requires a minimum of four print stations; more may be required if a particular color is to be emphasized. The press may contain another station to apply spot lacquer to various portions of the printed document, and may also feature one or more "perfection" assemblies that invert the recording medium to obtain two-sided printing.

A number of difficulties attend both the platemaking and ink-transfer stages of printing. The photographic process used to produce conventional plates is time-consuming and requires a facility and equipment adequate to support the necessary chemistry. To circumvent this process, practitioners have developed a number of electronic alternatives to plate imaging, some of which can be utilized on-press. With these systems, digitally controlled devices alter the ink-receptivity of blank plates in a pattern representative of the image to be printed. Such imaging devices include sources of electromagnetic-radiation pulses, produced by one or more laser or non-laser sources, that create chemical changes on plate blanks (thereby eliminating the need for a photographic negative); ink-jet equipment that directly deposits ink-repellent or ink-accepting spots on plate blanks; and spark-discharge equipment, in which an electrode in contact with or spaced close to a plate blank produces electrical sparks to physically alter the topology of the plate blank, thereby producing "dots" which collectively form a desired image.

Although these technologies have relieved press operators of the need to perform many of the manual tasks required by traditional equipment, a number of inconvenient operations remain. One such troublesome chore is replacement of plate material between printing jobs. While on-press imaging systems simplify or eliminate the need to register the print stations, today's equipment requires engagement of plate blanks much like presses that utilize conventional, photographically processed plates. This necessity detracts from the convenience offered by on-press imaging, and limits the time savings that might otherwise be achieved using such systems.

DESCRIPTION OF THE INVENTION

Brief Summary of the Invention

The present invention automates the process of removing used plates and mounting new plate material onto the plate cylinders of a lithographic press. A feeder spool installed within each plate cylinder contains a rolled supply of plate material (as described, for example, in any of U.S. Pat. Nos. 4,911,075; 5,106,695; 5,165,345; and U.S. Application Ser. Nos. 07/894,027 and 08/062,431), which wraps around the cylinder and is received by an uptake spool, also located within the cylinder. Although such arrangements are common in various graphic-arts applications (particularly electrophotographic copiers), the environment of lithographic printing poses especially demanding requirements not met by devices in the prior art.

As an example of a suitable environment for the present invention, FIG. 1 of the drawings shows a central-impression offset press indicated generally at 10, and which can print copies using any type of lithographic plate. Press 10 includes a plate cylinder or drum 12 around which is wrapped a lithographic plate 13 whose opposite edge margins are secured to the plate by a clamping mechanism 12*a*, as typical in the prior art. Cylinder 12, or more precisely the plate 13 thereon, contacts the surface of a blanket cylinder 14 which, in turn, rotates in contact with a large diameter impression cylinder 16. The paper sheet P to be printed on is mounted to the surface of cylinder 16 so that it passes through the nip between cylinders 14 and 16 before being discharged to the exit end of the press 10. Ink for inking plate 13 is delivered by an ink train 22, the lowermost roll 22*a* of which is in rolling engagement with plate 13 when press 10 is printing. As is customary in presses of this type, the various cylinders are all geared together so that they are driven in unison by a single drive motor.

Plate 13 experiences significant tangential force as a result of contact with the blanket cylinder and paper sheets; this is due to slight differences in the rolling diameters of the mating cylindrical surfaces, which are in contact at sufficient pressure to compress the compliant blanket cylinder surface. This tangential force will alter the orientation of the plate or dislodge it completely unless it is held against cylinder 12 with adequate force. Accordingly, a plate-material "payout" system must maintain strong contact between the plate material and the cylinder, but must also be capable of sufficient relaxation to permit smooth supply and uptake of the material. The present invention provides for the requisite tensioning force.

Furthermore, unlike many supply mechanisms in the prior art, the dispensing and uptake spools in a lithographic press should be removable so as to permit the cylinder to be reloaded with fresh plate material. The present invention accommodates the use of independent rollers or cassettes that may be conveniently loaded and removed.

We note that, while the preceding discussion contemplates a central-impression type press, the present invention is fully suited to in-line designs, and may also be utilized (although with less advantage) with imaging systems that operate off-press.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 2:
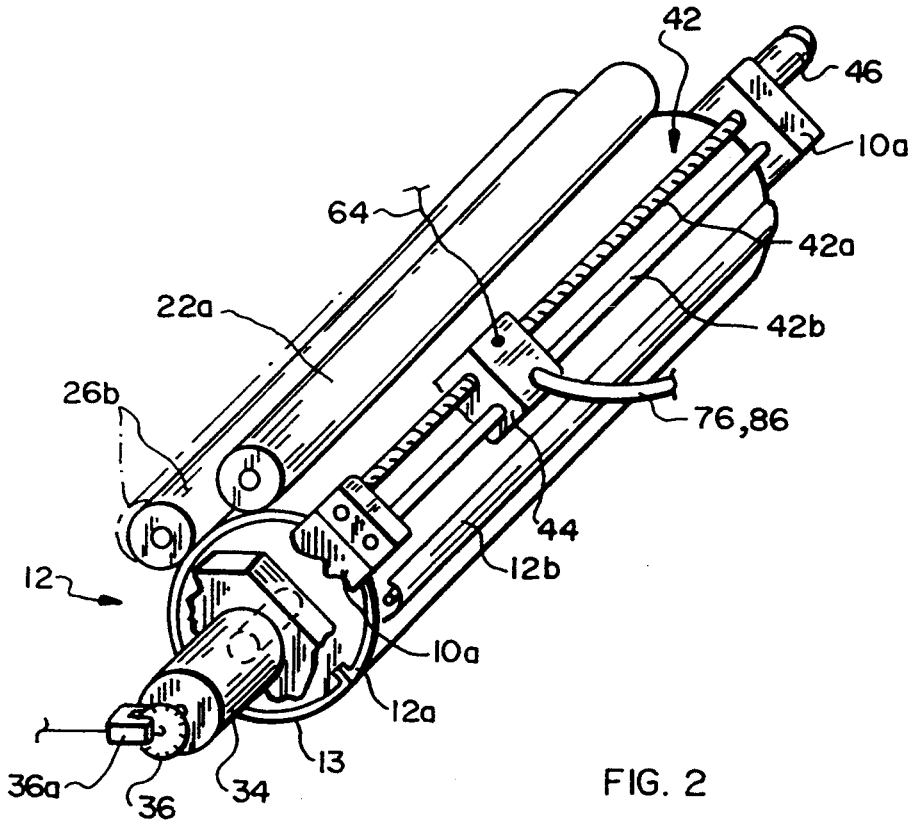
FIG. 2 (PRIOR ART)
FIG. 2 is an isometric view on a larger scale showing in greater detail the plate cylinder portion of the FIG. 1 press.

Suitable apparatus for on-press imaging is illustrated in FIG. 2. As shown therein, the plate cylinder 12 is rotatably supported by the press frame 10*a* and rotated by a standard electric motor 34 or other conventional means. The angular position of cylinder 12 is monitored by conventional means such as a shaft encoder 36 and a detector 36*a*; the encoder 36 rotates with the motor armature.

Also supported on frame 10*a* adjacent to plate cylinder 12 is a writing head assembly shown generally at 42. This assembly comprises a lead screw 42*a* whose opposite ends are rotatably supported in the press frame 10*a*, which frame also supports the opposite ends of a guide bar 42*b* spaced parallel to lead screw 42*a*. Mounted for movement along the lead screw and guide bar is a carriage 44. When the lead screw is rotated by a stepper motor 46, carriage 44 is moved axially with respect to plate cylinder 12.

The cylinder drive motor 34 and stepper motor 46 are operated in synchronism by a controller (not shown), which also receives signals from detector 36*a* so that, as the plate cylinder rotates, the carriage 44 scans axially along the cylinder with the controller "knowing" the instantaneous relative position of the carriage and cylinder at any given moment. The control circuitry required to accomplish this is well known in the scanner and plotter art. Other control circuitry, such as that described in the '075 patent, directs the activity of a writing head contained within carriage 44, causing the application at selected points in the scan of imaging pulses (e.g., laser discharges, spark or plasma discharches, or ink jets) directed toward the surface of plate 13. The discharges occur in response to picture signals representing the image to be impressed on the plate, and cause ablation or other surface modification that changes the affinity of the plate for ink and/or water (depending on whether the press is to print in a "dry" or "wet" mode).

Figure 1:
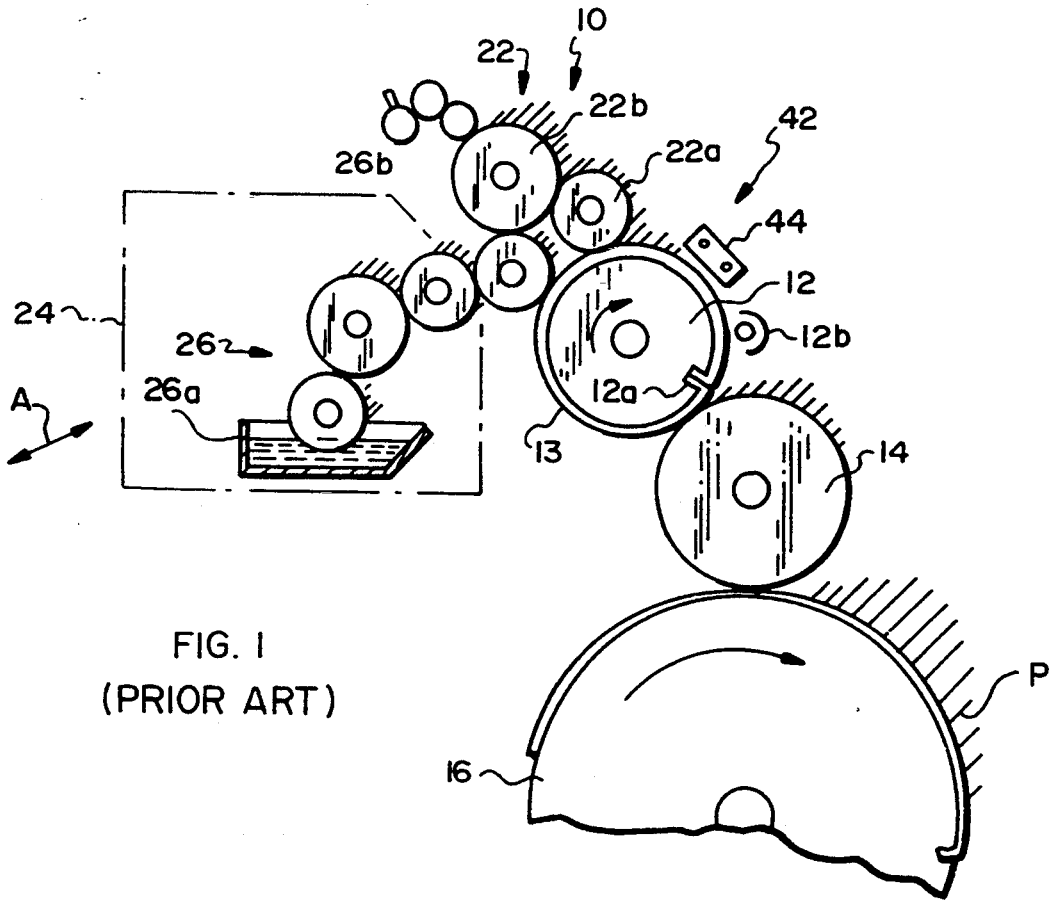
FIG. 1 (PRIOR ART)
FIG. 1 is a partial diagrammatic view of a conventional offset press incorporating a lithographic printing plate.
Figure 3:
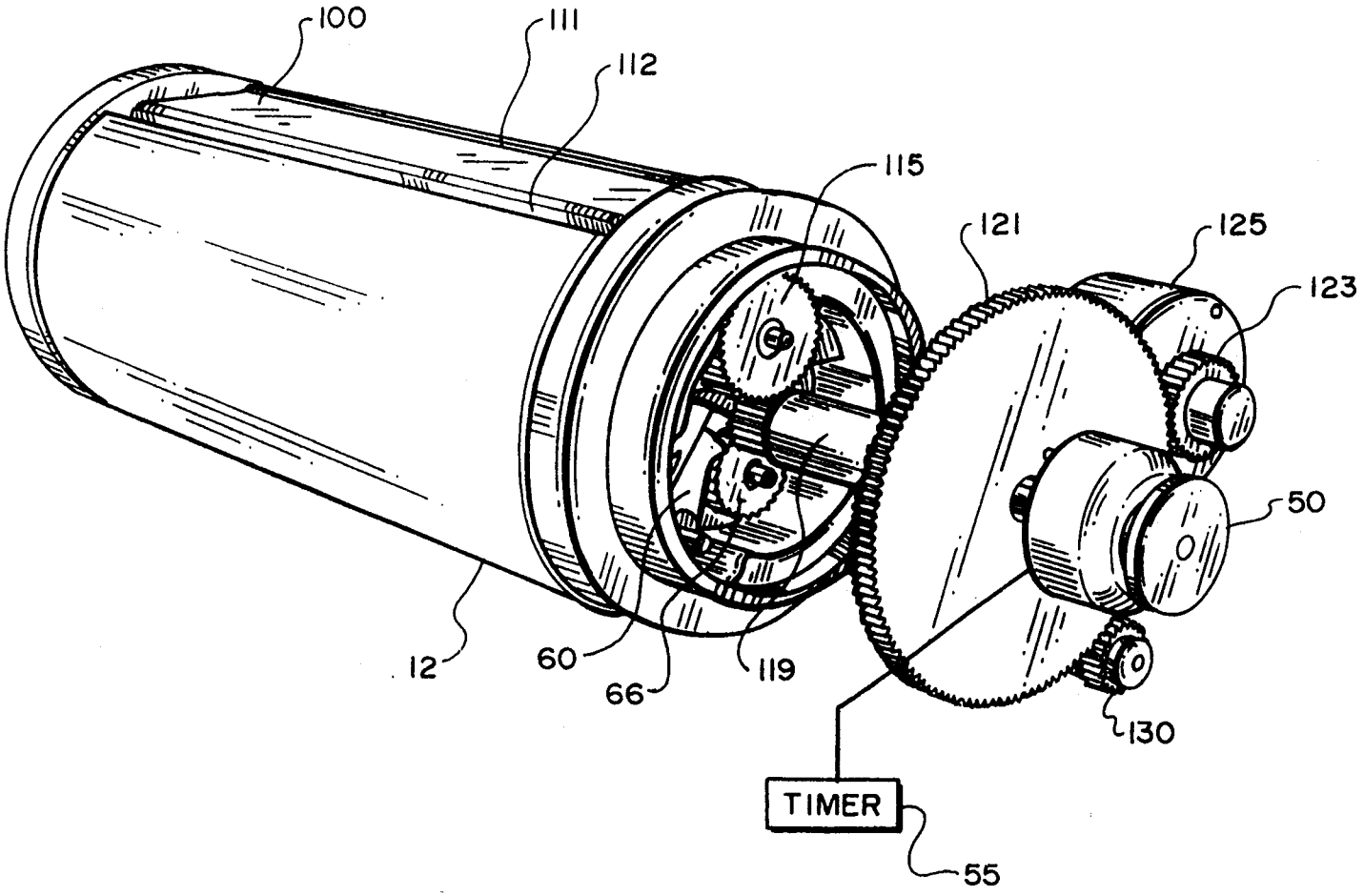
FIG. 3 is an isometric view of the plate cylinder containing the components of the present invention.
Figure 4:
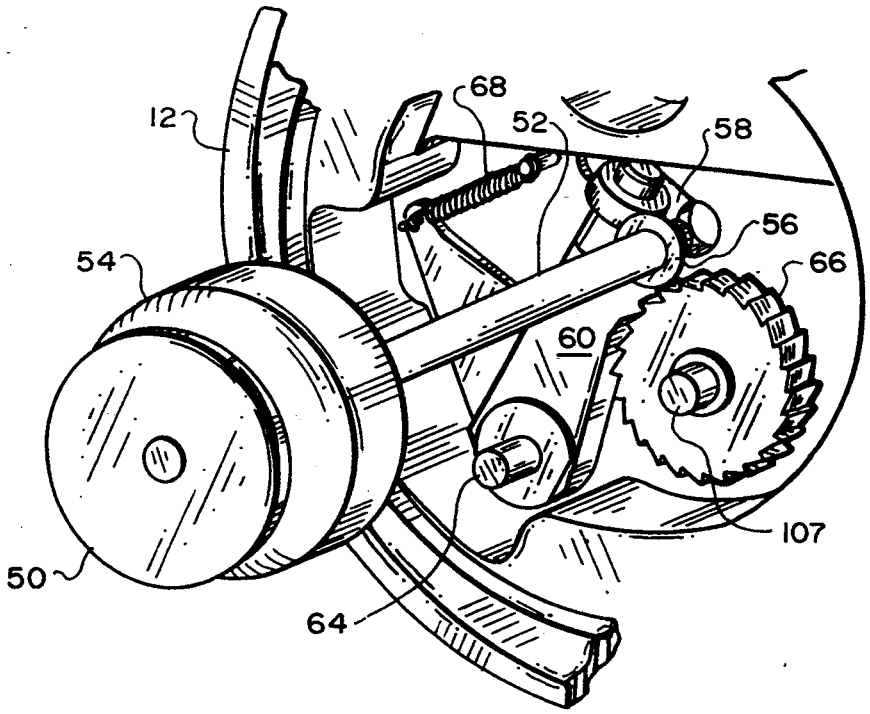
FIG. 4 is a detail of the major components of the supply and locking mechanisms of the present invention.

The present invention provides additional mechanical features that enable the press configuration shown in FIGS. 1 and 2 to accommodate a continuous supply of plate material. Refer now to FIGS. 3 and 4, which illustrate the primary mechanism of our plate-material supply and uptake apparatus. With particular reference to FIG. 4, a solenoid armature 50 engages a shaft 52 that passes through a solenoid 54 and terminates in a linear cam 56. An internal spring (not shown) urges shaft 52 and armature 50 axially outward from cylinder 12. Cam 56 rests against a linear cam follower 58 such that linear movement of armature 50 advances shaft 52 (against the tension of the internal spring) with consequent radial displacement of cam follower 58. The necessary movement of armature 50 may be accomplished manually or, in the preferred embodiment, by electrical activation of solenoid 54, which retains shaft 52 in its shifted position. Solenoid 54 is also connected to a timer 55, which is activated along with solenoid 54 and itself acts to deactivate and disengage solenoid 54 after a preset time has elapsed.

Cam follower 58 extends from a pawl 60, which rotates on a pivot 64. The tooth of pawl 60 engages a ratchet 66 (whose function is described below). A pawl spring 68, extending between the arm of pawl 60 and a point within plate cylinder 12 that remains stationary with respect to pawl 60, urges pawl 60 against ratchet 66. Accordingly, the displacement of cam follower 58 caused by linear movement of shaft 52 and cam 56 counteracts the action of spring 68, releasing pawl 60 from engagement with ratchet 66.

Figure 5:
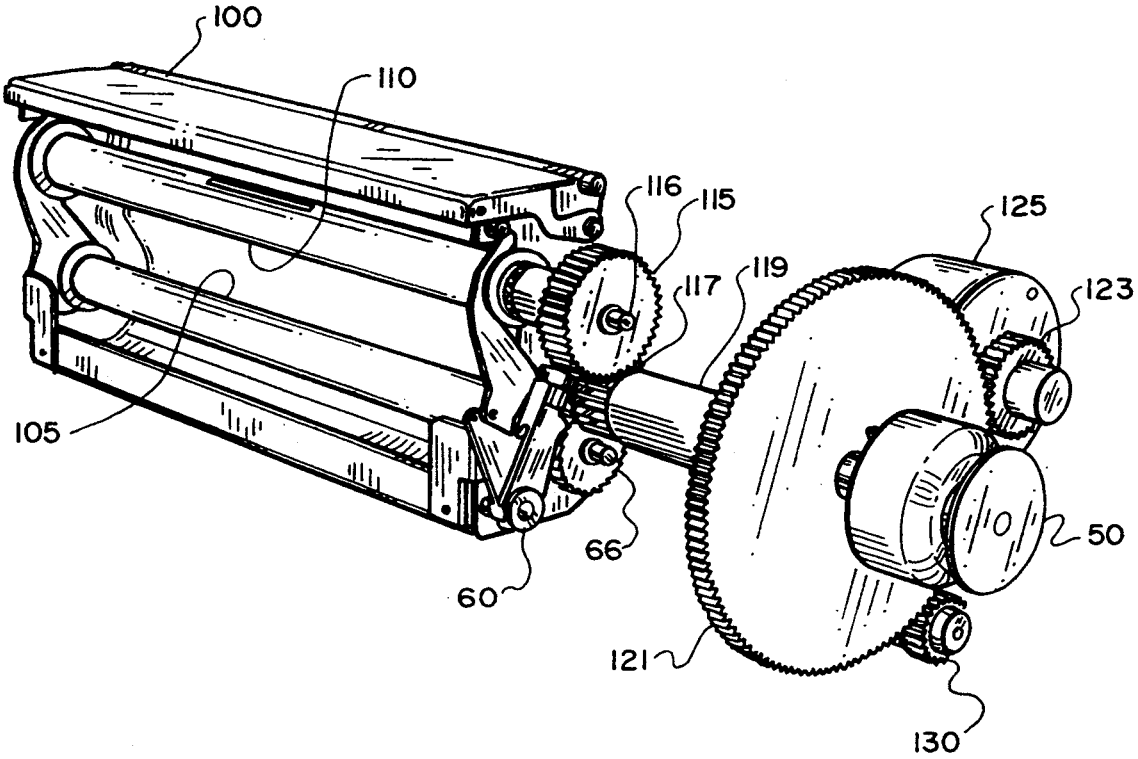
FIG. 5 is an isometric view of a supply-and-uptake cassette for dispensing plate material around the plate cylinder, shown in conjunction with the major components of the present invention.

Refer now to FIG. 5, which illustrates the mechanism by which plate material is released and taken up. That mechanism is packaged as a removable, replaceable cassette 100, which ordinarily resides within the body of cylinder 12 as shown in FIG. 3. Cassette 100 includes a plate-material supply mandrel 105, which is coupled to the shaft 107 of ratchet 66 (see FIG. 4), and a plate material uptake mandrel 110 that engages gear 115 and its integral shaft 116. Thus, when pawl 60 disengages ratchet 66, supply mandrel 105 is free to rotate and dispense fresh plate material.

Figure 6:
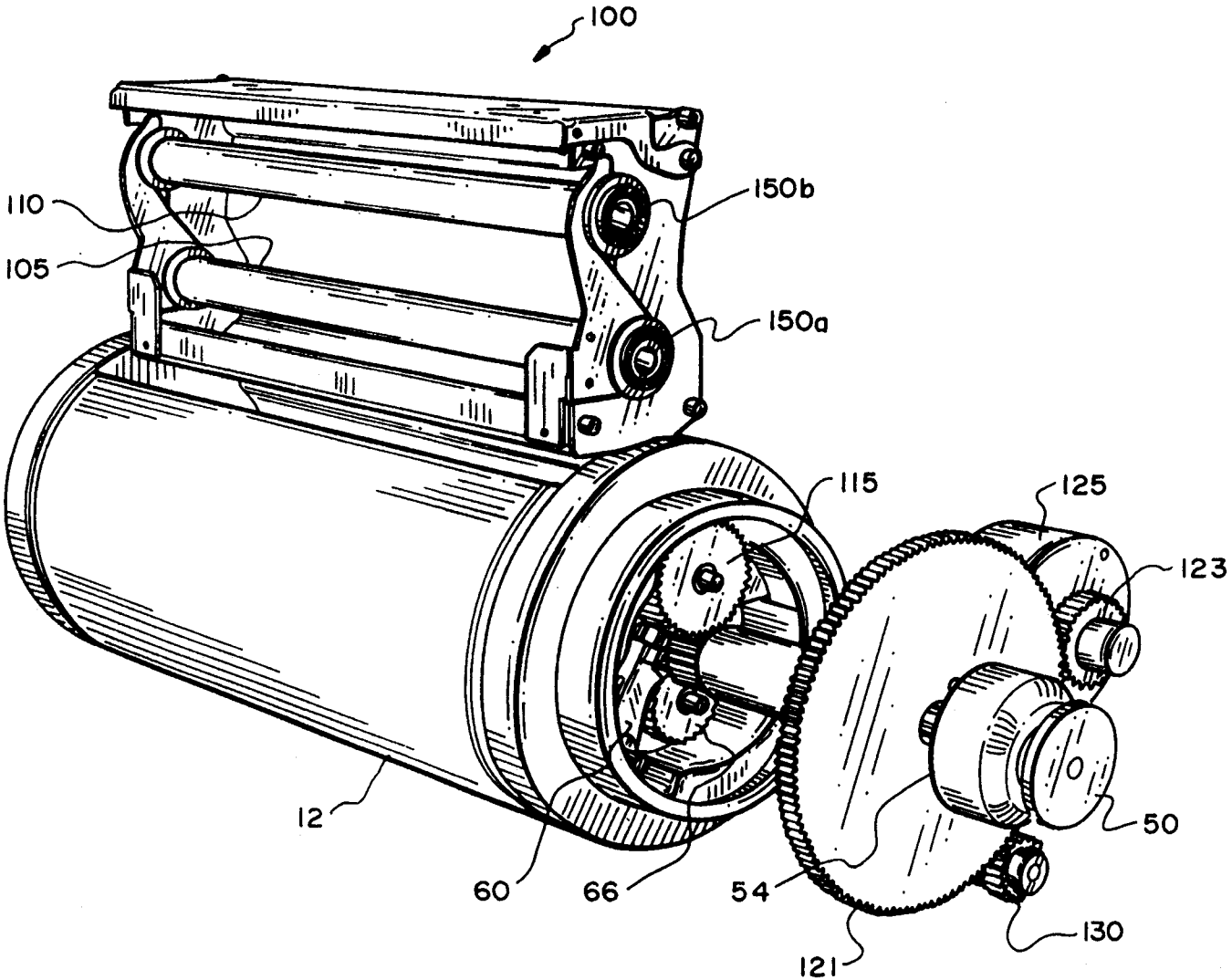
FIG. 6 is an isometric view of the plate cylinder showing the manner in which the cassette is introduced therein.

Cassette 100 is introduced into plate cylinder 12 as shown in FIG. 6, and as more specifically described below. During operation, plate material from supply mandrel 105 emerges from a space 111 between the top of cassette 100 and the wall of cylinder 12, wraps around cylinder 12 and re-enters the body of cylinder 12 through an opposing space 112 onto uptake mandrel 110.

Also as shown in FIG. 5, uptake mandrel 110 is coupled to an uptake gear 115 by means of integral shaft 116. Uptake gear 115 meshes with a shaft gear 117 coaxial with linear cam shaft 52; shaft gear 117, not shown in FIG. 4 for clarity of presentation, resides just behind cam 56. As shown in FIGS. 3 and 5, shaft 52 is surrounded by a sleeve 119, which contains the internal spring mentioned above, and is also secured to a large gear 121. Gear 121 meshes with a brake gear 123, which extends from an electrically controlled brake 125, and also with a detector gear 130. Detector gear 130 is coupled to a resettable relay that controls the current flow to brake 125.

Operation of the plate-winding mechanism of the present invention may be understood with continued reference to FIGS. 3–6. Ordinarily, shaft 52 rotates with cylinder 12 and gear 115 remains stationary with respect to shaft 52; gear 121 rotates with respect to gears 123 and 130, which offer no resistance thereto. Axial movement of solenoid armature 50 and shaft 52 (which are preferably isolated mechanically from shaft 52 so as to remain conveniently stationary) results in disengagement of pawl 60 and consequent release of supply mandrel 105, as described above, as well as actuation of timer 55 and brake 125. With brake 55 engaged, rotation of shaft 52 and shaft gear 117 is arrested. Cylinder 12 and cassette 100 contained therein continue to rotate, however, and with shaft gear 117 now rendered stationary, rotation of of cylinder 12 causes uptake gear 115 to rotate about shaft gear 117 as a "planet" gear, turning uptake mandrel 110 to draw plate material from supply mandrel 105 (itself now free to rotate due to disengagement of pawl 60). A one-way roller clutch (not shown) prevents reverse rotation of uptake mandrel 110.

The period of timer 55 determines the amount of plate material that will be advanced during an uptake cycle. That period is set such that, at a given rotation rate, just enough plate material is withdrawn to cover the surface of cylinder 12. When the period of timer 55 expires, reflecting completion of the uptake cycle, it deactivates solenoid 54, resulting in re-engagement of pawl 60 and ratchet 66 and consequent locking of supply mandrel 105. Brake 125, however, remains active, preventing rotation of gears 121 and 117, so that uptake gear 115 continues to turn about shaft gear 117 as cylinder 12 rotates. As additional plate material is wound onto uptake mandrel 110, the tension in the plate material along the exterior of cylinder 12 increases. This augments the torque on gear 121 and, consequently, on brake 125 as well. The maximum torque on brake 125 is set by the user (e.g., in the case of a current-limited brake arrangement, by the applied electrical current) and, when this torque is exceeded, brake 125 slips and gear 121 begins to rotate. This is sensed by detector gear 130, resulting in an immediate cutoff of power to brake 125. Unimpeded by brake 125, shaft 52 is then free once again to rotate. The tension established along the plate material is maintained by the one-way clutch (which prevents material from leaving uptake mandrel 110) and ratchet 66 and pawl 60 (which prevent material from being drawn off the supply mandrel).

The supply and uptake mandrels can be anchored to the main plate-cylinder housing in any number of suitable ways. As shown in FIGS. 5 and 6, in the preferred embodiment they are contained within a removable cassette 100. A pair of toothed couplings **150*a*, 150*b* connect the supply and uptake mandrels to ratchet 66 and uptake gear 115, respectively, by means of complementary couplings (not shown) affixed thereto. A series of orientation pins, which mate with apertures within cylinder 12, ensure proper alignment of these couplings upon introduction of cassette 100 within cylinder 12. Engagement of cassette 100 within the body of cylinder 12 is facilitated by means of circular ramp cam surfaces that act on roller bearings and permit smooth introduction and locking of cassette 100 after the pins and couplings have been aligned appropriately. The structural elements of cassette 100** are preferably hinged together to permit convenient separation thereof and removal of the supply and uptake mandrels for replenishment.

It will therefore be seen that we have developed a reliable and convenient mechanism for dispensing and receiving material that wraps around a cylinder, and which is especially suited to lithographic printing systems. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed. In particular, any number of metering systems other than a timer can be used to control the cycle duration (and, therefore, the amount of material dispensed from supply mandrel 105); it is possible, for example, to utilize the output of angular position-sensing control circuitry already employed to monitor the rotation of cylinder 12 as a means of gauging the dispensation cycle as well, or to use a metering roller within cylinder 12 to directly measure the amount of material unrolled from supply mandrel 105. Detector gear 130 can be replaced with other means of motion detection or a brake assembly designed to disengage upon slippage; alternatively, a timer can be used to cut off power to brake 115 after a completion of the uptake cycle.

What is claimed is:

1. Apparatus for winding lithographic plate material onto a plate cylinder adapted for rotation about a longitudinal axis, the apparatus comprising:

a. a plate cylinder;

b. supply means located within the cylinder for dispensing lithographic plate material in web form;

c. uptake means, located within the cylinder, for withdrawing material from the dispensing means, the path from the supply means to the uptake means extending around the cylinder;

d. means for restraining rotation of the uptake means;

e. mechanical locking means for restraining rotation of the supply means;

f. braking means for establishing a predetermined amount of tension along the material wrapped around the cylinder;

g. means for selectably disengaging the supply and uptake rotation-restraining means;

h. means for causing rotation of the cylinder to draw material round the cylinder from the supply means;

i. means for monitoring the amount of plate material dispensed; and j. means for re-engaging the rotation-restraining means upon dispensation of a predetermined amount of material, thereby retaining the predetermined amount of tension along the material wrapped around the cylinder.

2. The apparatus of claim 1 wherein the cylinder includes a longitudinal shaft and a gear fixed with respect thereto, and the uptake means includes an uptake shaft and a gear fixed with respect thereto and which, during uptake, rotates about the gear fixed with respect to the longitudinal shaft.

3. The apparatus of claim 1 wherein the means for restraining rotation of the supply shaft is a pawl-and-ratchet assembly that may be selectably disengaged to cause dispensation and uptake of material around the cylinder.

4. The apparatus of claim 1 wherein the braking means includes a brake that slips upon application of the predetermined torque on the uptake shaft.

5. The apparatus of claim 1 further comprising means for supporting the supply and uptake shafts, which means is removable from the cylinder.

6. The apparatus of claim 1 wherein (i) the supply rotation-restraining means, (ii) the braking means, (iii) the disengagement means and (iv) the means for causing rotation of the supporting means to supply power for drawing material around the supporting means are all disposed externally to the plate cylinder.

7. An apparatus for imaging a lithographic printing plate, the apparatus comprising:

a. means for supporting lithographic plate material;

b. means for rotating the supporting means;

c. at least one discharge source for applying an image to the plate material and means for moving the at least one discharge source relative to the supporting means so that when the supporting means is rotated, the at least one discharge source scans a raster on the surface of the plate material;

d. control means responsive to electronic signals representing an original document for repeatedly actuating the at least one discharge source momentarily during the scan thereof so that the at least one discharge source forms on the plate-material surface an image comprised of dots corresponding to the original document;

e. means, disposed within the supporting means, for winding lithographic plate material onto the supporting means, the winding means comprising:

1) supply means, located within the supporting means, for dispensing lithographic plate material in web form;

2) uptake means, located within the supporting means, for withdrawing material from the dispensing means, the path from the supply means to the uptake means extending around the supporting means;

3) means for restraining rotation of the uptake means;

4) mechanical locking means for restraining rotation of the supply means;

5) braking means for establshing a predetermined amount of tension along the material wrapped around the supporting means;

6) means for selectably disengaging the supply and uptake rotation-restraining means;

7) means for causing rotation of the supporting means to supply power for drawing material around the supporting means from the supply means;

8) means for monitoring the amount of plate material dispensed; and 9) means for re-engaging the rotation-restraining means upon dispensation of a predetermined amount of material, thereby retaining the predetermined amount of tension along the material wrapped around the supporting means.

8. A lithographic printing press comprising at least one print station, each station including:

a. a plate cylinder;

b. a blanket cylinder in rolling engagement with the plate cylinder;

c. ink-supply means for providing ink to the plate cylinder;

d. at least one discharge source for applying an image to plate material wrapped around the plate cylinder;

e. means for moving the at least one discharge source relative to the plate cylinder so that when the plate cylinder rotates, the at least one discharge source scans a raster on the surface of the plate material;

f. control means responsive to electronic signals representing an original document for repeatedly actuating the at least one discharge source momentarily during the scan thereof so that the at least one discharge source forms on the plate-material surface an image comprised of dots corresponding to the original document;

g. means, disposed within the plate cylinder, for winding lithographic plate material onto the plate cylinder, the winding means comprising:
   1) supply means, located within the supporting means, for dispensing lithographic plate material in web form;
   2) uptake means, located within the supporting means, for withdrawing material from the dispensing means, the path from the supply means to the uptake means extending around the supporting means;
   3) means for restraining rotation of the uptake means;
   4) mechanical locking means for restraining rotation of the supply means;
   5) braking means for establishing a predetermined amount of tension along the material wrapped around the supporting means;
   6) means for selectably disengaging the supply and uptake rotation-restraining means;
   7) means for causing rotation of the supporting means to supply power for drawing material around the supporting means from the supply means;
   8) means for monitoring the amount of plate material dispensed; and
   9) means for re-engaging the rotation-restraining means upon dispensation of a predetermined amount of material, thereby retaining the predetermined amount of tension along the material wrapped around the supporting means.

* * * * *